US006550222B2

(12) United States Patent
DeGrasse

(10) Patent No.: US 6,550,222 B2
(45) Date of Patent: Apr. 22, 2003

(54) METHOD AND APPARATUS FOR STRETCH WRAPPING A LOAD, INCLUDING A TOP PLATEN

(75) Inventor: Steven E. DeGrasse, New Albany, IN (US)

(73) Assignees: Lantech Management Corp., Louisville, KY (US); Lantech Holding Corp., Louisville, KY (US)

( * ) Notice: Subject to any disclaimer, the term of this patent is extended or adjusted under 35 U.S.C. 154(b) by 0 days.

(21) Appl. No.: 09/985,247

(22) Filed: Nov. 2, 2001

(65) Prior Publication Data

US 2002/0056259 A1 May 16, 2002

Related U.S. Application Data

(60) Provisional application No. 60/244,925, filed on Nov. 2, 2000.

(51) Int. Cl.[7] ..... B65B 11/04; B65B 13/20

(52) U.S. Cl. ..... 53/399; 53/438; 53/529; 53/587

(58) Field of Search ..... 53/399, 436, 438, 53/411, 528, 529, 556, 587, 588; 100/15, 27

(56) References Cited

U.S. PATENT DOCUMENTS

| | | | | |
|---|---|---|---|---|
| 5,020,300 A | * | 6/1991 | Casteel | 53/441 |
| 5,195,297 A | * | 3/1993 | Lancaster et al. | 53/556 |
| 5,588,287 A | * | 12/1996 | Lerner et al. | 53/588 |
| 5,893,258 A | * | 4/1999 | Lancaster, III | 53/587 |

* cited by examiner

*Primary Examiner*—John Sipos
(74) *Attorney, Agent, or Firm*—Finnegan, Henderson, Farabow, Garrett & Dunner, L.L.P.

(57) ABSTRACT

Loads on pallets are often wrapped with a plastic film for shipping. The present invention relates to top platen devices used to maintain stability in loads while the load is wrapped for shipping. The top platen device applies a compressive force to the load to stabilize the load while it is being wrapped. The top platen includes a shaft supporting platen pad which is placed on top of the load. The shaft and platen pad are configured to rotate eccentrically with respect to the geometric center of the top platen in order to rotate with the load about the load's center of rotation.

31 Claims, 11 Drawing Sheets

METHOD AND APPARATUS FOR STRETCH WRAPPING A LOAD, INCLUDING A TOP PLATEN

This application claims the right to priority based on Provisional Application No. 60/244,925 filed Nov. 2, 2000, and entitled "Method and Apparatus for Stretch Wrapping a Load Including a Top Platen," the full contents of which are incorporated herein by reference.

BACKGROUND OF THE INVENTION

1. Field of the Invention

The present invention relates to wrapping a load with packaging material, and more particularly, to stabilizing the load while the load is wrapped with packaging material.

2. Description of the Related Art

Various packaging techniques have been used to build a load of unit products and subsequently wrap them for transportation, storage, containment and stabilization, and protection and waterproofing. One system uses stretch wrapping machines to stretch, dispense, and wrap stretch wrap packaging material around a load. Stretch wrapping can be performed as an inline automated packaging technique which dispenses and wraps packaging material in a stretched condition around a load on a pallet to cover and contain the load. Pallet stretch wrapping, whether accomplished by turntable, rotating arm, or rotating ring typically covers the four vertical sides of the load with a stretchable film such as polyethylene film. In each of these arrangements, relative rotation is provided between the load and a packaging material dispenser to wrap packaging material about the sides of the load.

Wrapping packaging material about the sides of the load typically unitizes and stabilizes the load. However, such side wrapping by itself generally does not secure the load to the pallet in a manner which would promote increased stability. Due to the structure of a typical stretch wrap apparatus, it is difficult to stabilize the load during wrapping and to secure the load to the pallet in a stable manner.

To increase stability to the load during the wrapping cycle, top platens are used. FIG. 2 illustrates how a conventional top platen 101 typically provides stability to a load 102 being wrapped. In FIG. 2, a load 102 is "column stacked." In a column stacked configuration, boxes 110 (or whatever is stacked to comprise the load 102) are not interlocked with layers above or below, rather, box walls are flush.

This is the most unstable type of load. Without a top platen 101 or other type of support, rotation often leads to column tilt 124, shown in phantom in FIG. 2, and sometimes to collapse. The top platen 101 provides stability in at least two ways. First, a vertical compressive force 104 is applied to the load 102 and to the turntable plate, forcing the faces of the boxes to square themselves vertically 123. Second, the applied force 104 makes use of friction between a platen pad 105 and the load 102 to create a restrictive force 125, which keeps the boxes 110 from sliding away from a center of rotation 140 of the load 102.

There are at least two problems common to all wrapping devices which use a conventional top platen. The first, illustrated in FIG. 4A, is that the top platen arm frame 111, shaft 112, or platen mast or frame 113 can be manufactured out of square or can flex, causing the rotational axis 149 of the platen pad 105 to be out of square and thus misaligned or unaligned with the center of rotation 140 of the load 102.

The second and more serious problem, illustrated in FIG. 4B, is that the rotational axis 149 of the top platen pad 105 is fixed, passing through the geometric center or longitudinal axis of the shaft and platen pad of the top platen. Almost always, this means that the rotational axis 149 of the platen pad 105 is in a different location than the center of rotation 140 of the top of the load 102. The top platen pad 105 can be adjusted so its rotational axis 149 will closely match the load center of rotation 140 at some vertical position. But as shown in FIG. 10, the center of rotation 140 of the top of load 102 may be at a different position with respect to the rotational axis 149 of the top platen 105 for loads of different heights as seen at points A, B, and C. Wear or tolerance in the manufacturing of the turntable 122 may result in an uneven turntable surface, thus affecting the location of the center of rotation of the turntable and ultimately the center of rotation 140 of the load 102. Thus, when the vertical position of the top of the load changes, i.e., a short load is wrapped after a tall load is wrapped, the rotational axis 149 of the platen pad 105 may not be aligned with the center of rotation 140 of the top of the load 102.

These problems exist with all conventional top platens, regardless of whether the load or the wrapping device rotates. The problem involving the center of rotation 140 of the top of the load 102 and the rotational axis 149 of the platen pad 105 can create several undesirable effects. One of the more serious effects is that as the top of the load rotates about a different center 140 than the platen pad's rotational axis 149, the platen pad 105 and the load 102 will grind against each other. This grinding may cause wrapping material 103 placed between the load 102 and the platen pad 105 to rip, tear, or be ground away. Additionally, the load 102 itself may be affected. Loads comprised of tightly packed together units such as bricks or boxes 110, for example, may shift and move as a result of the grinding. The shifted units 110 may create open spaces in what was a tightly packed load. If the rotational axis 149 of the platen pad 105 and the rotational center of the load 140 are sufficiently misaligned, units 110 may shift and fall off of the load 102. If the rotational axis 149 of the platen pad 105 is not aligned with the center of rotation 140 of the top of the load 102, the platen device 101 may make the load 102 more unstable instead of providing stability to the load 102 due to grinding, wobbling, or pushing the load 102 out during rotation caused by misalignment.

As shown in FIG. 10, in conventional stretch wrapping devices with turntables 122, when the rotational axis 149 of the platen pad 105 and the center of rotation 140 of the turntable 122 are out of alignment, the amount of misalignment between the rotational axis 149 of the platen pad 105 and the center of rotation 140 of the top of the load 102 depends on the height of the load, where more misalignment is found with taller loads. For example, when a 90 inch high load with a center of rotation 140 of the turntable 122 is 1/16 of an inch misaligned from the rotational axis 149 of the platen pad 105, the rotational axis 149 of the platen pad 105 and the center of rotation 140 of the top of the load 102 may be misaligned by as much as 5/8 inch. Similarly 1° of misalignment at the bottom of the load 102 may create a misalignment of 3 or 4 inches at the top of the load 102. A misalignment of ½ inch is enough to create unwanted grinding between the load 102 and the platen pad 105.

Conventionally, alignment techniques such as the use of a plumb bob may permit alignment of rotational axis 149 of the platen pad 105 and the center of rotation 140 of a load 102 of a given height. However, this and other similar alignment techniques are cumbersome and take time. The alignment of the rotational axis 149 of platen pad 105 and center of rotation 140 of load 102 must be recalibrated each time a load of a different height is used. Even when the same height of load is used, periodic recalibration is required due mechanical wear and flexing of machine parts.

SUMMARY OF THE INVENTION

In light of these problems, it is desirable to provide a top platen capable of aligning its center of rotation with a center of rotation of the top of a load in order to stabilize the load during wrapping.

The advantages and purpose of the invention will be set forth in part in the description which follows, and in part will be obvious from the description, or may be learned by practice of the invention. The advantages and purposes of the invention will be realized and attained by means of the elements and combinations particularly pointed out in the appended claims.

To achieve the advantages and in accordance with the purposes of the invention, as embodied and broadly described herein, a method and apparatus for stretch wrapping a load with a sheet of stretch wrap packaging material are provided.

According to one aspect of the invention, an apparatus for wrapping the load is provided. The apparatus includes a dispenser for dispensing stretch wrap material, means for providing relative rotation between the dispenser and a load, the load having a center of rotation, and a top platen having a geometric center, the top platen configured to apply a compressive force to the load and including a shaft and a platen pad attached to the shaft, the pad being configured to contact and transmit a compressive force to the load, wherein, when the platen pad is on top of the load and the geometric center of the top platen is not aligned with the load center of rotation, the platen pad and shaft are configured to rotate eccentrically with respect to the geometric center of the top platen in order to rotate about the load center of rotation.

According to another aspect of the invention, a method of wrapping the load is provided. The method includes dispensing stretch wrap packaging material from a packaging material dispenser, providing relative rotation between the dispenser and the load to wrap the stretch wrap packaging material around the load, wherein the load has center of rotation; placing a portion of a top platen on the top of the load, wherein the top platen includes a geometric center which is not aligned with the load center of rotation, and rotating the portion of the top platen on the top of the load with the load around the load center of rotation.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
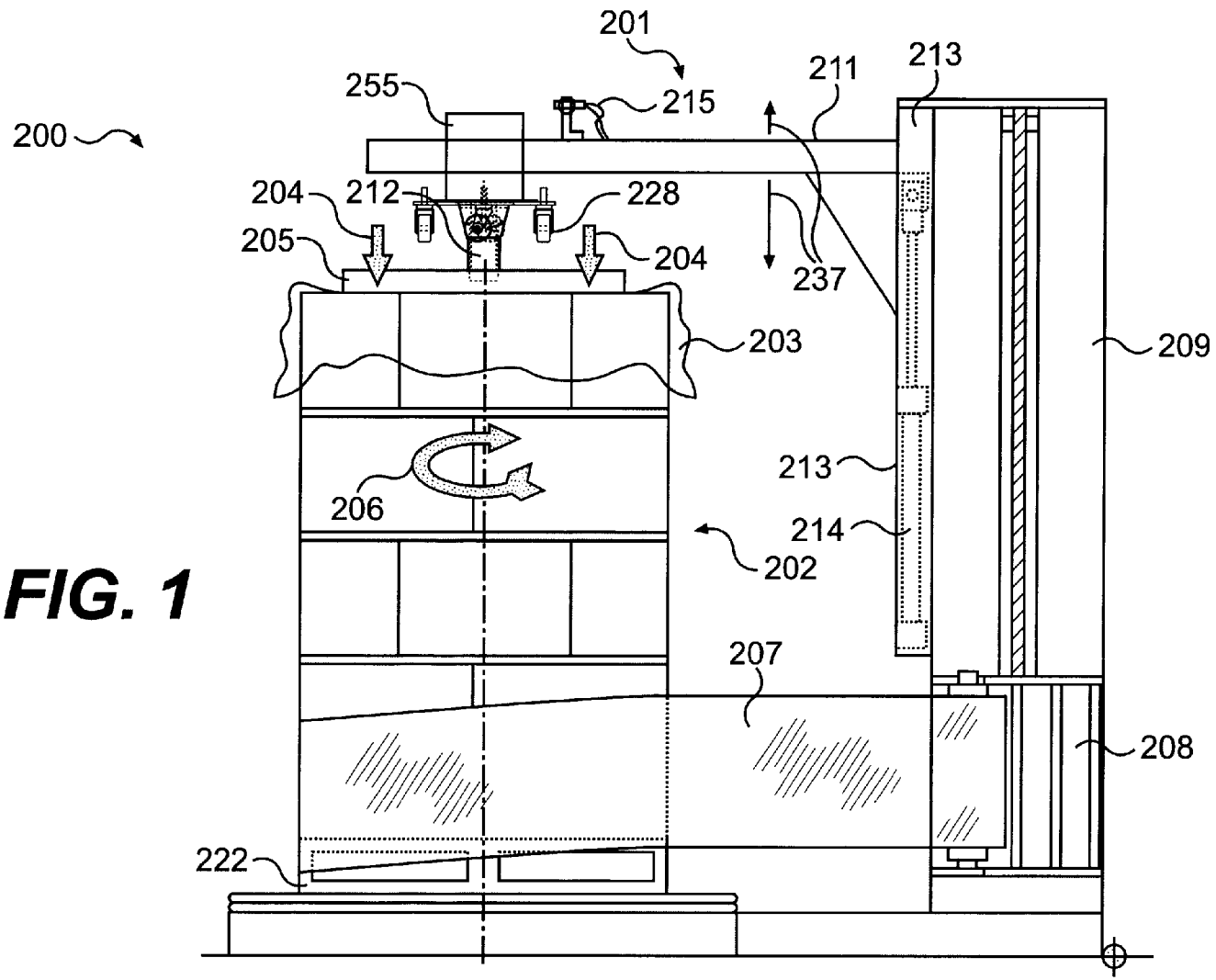
FIG. 1 is a side view of a load wrapping apparatus according to one aspect of the present invention.
Figure 2:
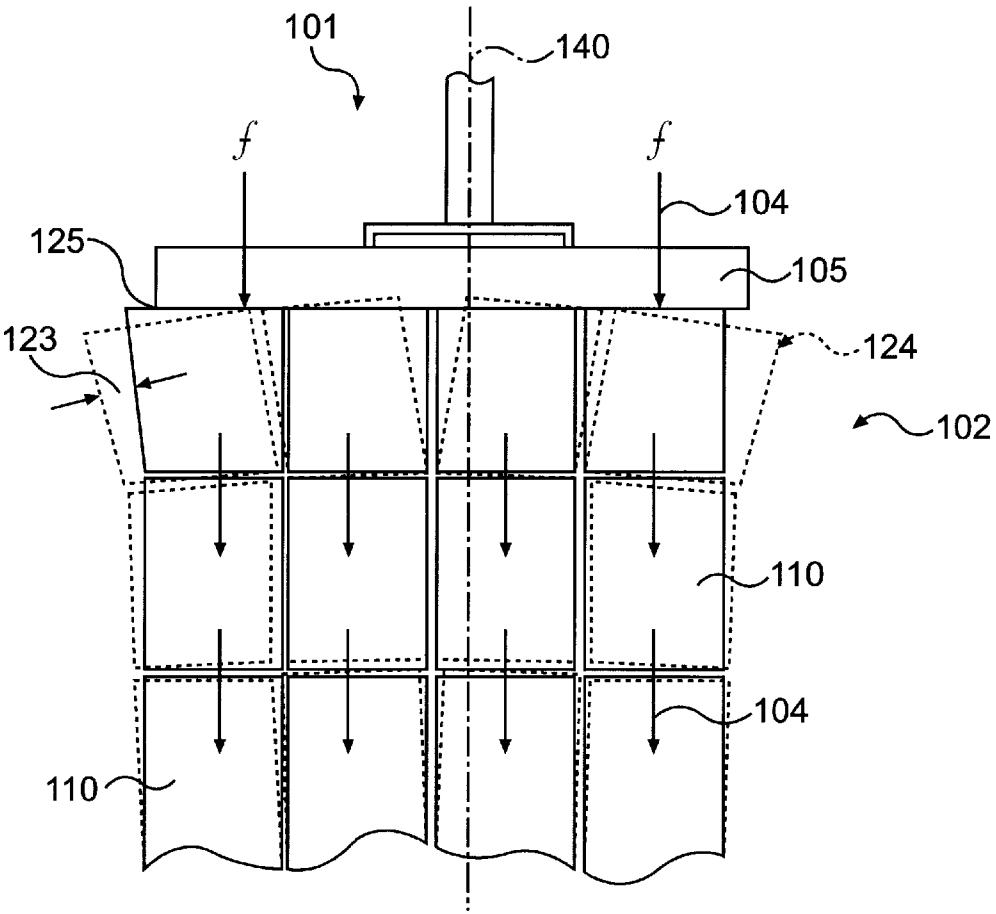
FIG. 2 PRIOR ART
FIG. 2 is a side view of a load of column stacked units squaring up due to the compressive pressure introduced by a conventional platen pad.

Reference will now be made in detail to present embodiments of the invention, examples of which are illustrated in the accompanying drawings. Wherever possible, the same reference numbers will be used throughout the drawings to refer to the same or like parts.

Benefits and advantages of the present invention include a platen pad that does not grind against, or push out a load. Rather, the improved top platen increases and adds to the stability of the load. These advantages are achieved, at least in part, by an improved top platen that permits a platen pad of the top platen to rotate around the center of rotation of the load. The platen pad is permitted to wobble, or rotate eccentrically with respect to its own rotational axis (i.e., it's longitudinal axis or geometric center). The platen pad is permitted to rotate eccentrically due in part to a large tolerance between a shaft, to which the platen pad is connected, and a hole in a shaft housing into which the shaft extends. Thus, the rotational axis of the top platen of the present invention is not geometrically fixed as it is in conventional top platens. However, the compressive force applied by the top platen is not sacrificed due to the unique structure of the top platen which applies the compressive force around the shifting rotational axis. Rolling elements permit a compressive force to be transmitted to the platen pad in a low friction way. The low friction transmittal of force permits the shaft to take advantage of the large tolerance.

In accordance with the invention, the present invention includes a method and apparatus for stretch wrapping a load with a sheet of stretch wrap packaging material. The wrapping apparatus 200, shown in FIG. 1, includes a stretch wrap packaging material dispenser 208 for dispensing stretch wrap packaging material 207, and a film mast 209, provided for guiding and supporting the dispenser 208. The apparatus may also include a frame or platen mast 213 for attaching a platen arm 211 and, optionally, the stretch wrap dispenser 208.

Figure 3A:
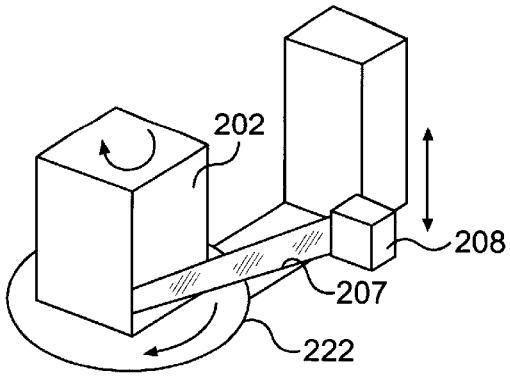
FIG. 3A is an isometric view of a wrapping apparatus where the load rotates.
Figure 3B:
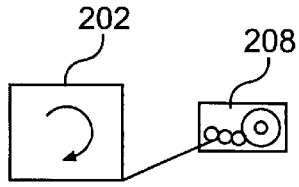
FIG. 3B is a top view of the apparatus of FIG. 3A.
Figure 3C:
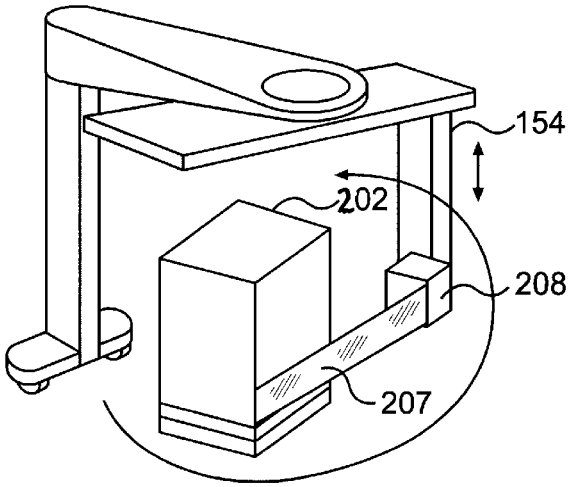
FIG. 3C is an isometric view of a wrapping apparatus where the file dispenser rotates about the load.
Figure 3D:
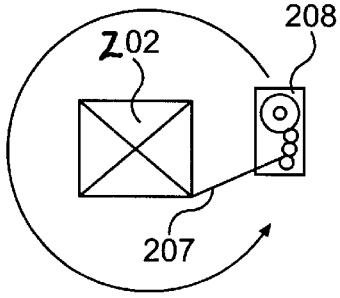
FIG. 3D is a top view of the apparatus of FIG. 3C.
Figure 3E:
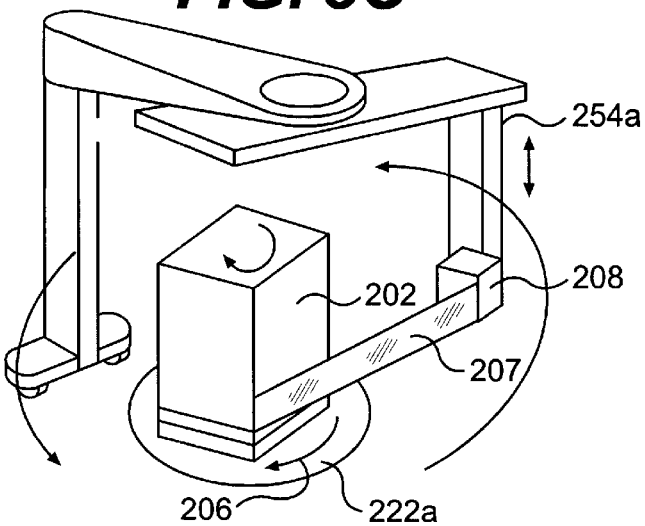
FIG. 3E is an isometric view of a wrapping apparatus where the load and the film dispenser rotate in opposite directions.
Figure 3F:
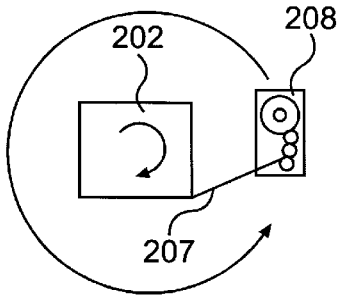
FIG. 3F is a top view of the apparatus of FIG. 3E.
Figure 4A:
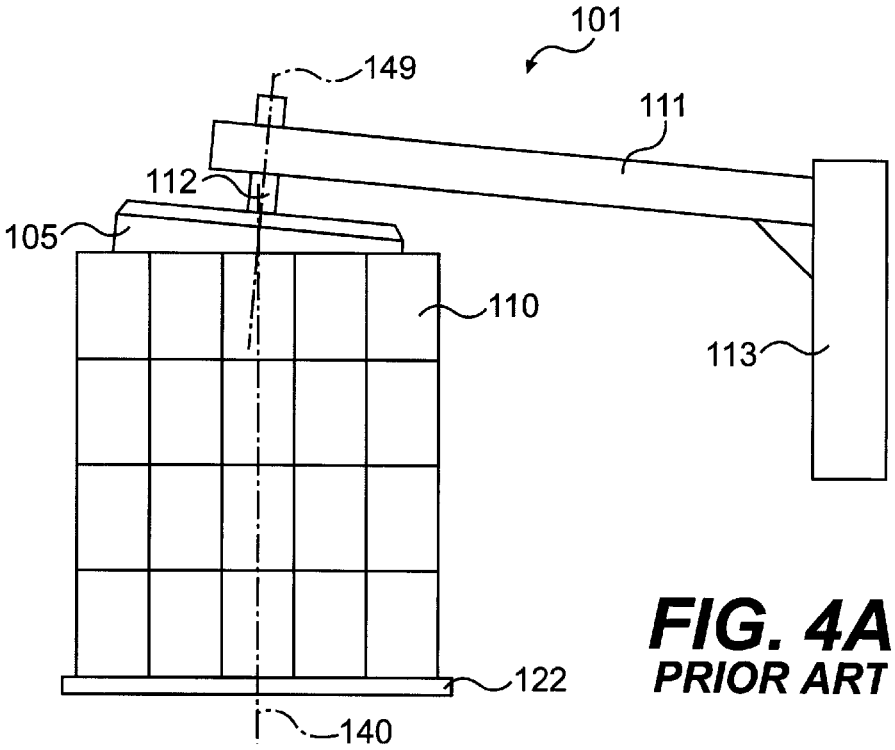
FIG. 4A PRIOR ART
FIG. 4A is a side view of a conventional top platen where the relative center of rotation of the platen pad and the load are not parallel.
Figure 4B:
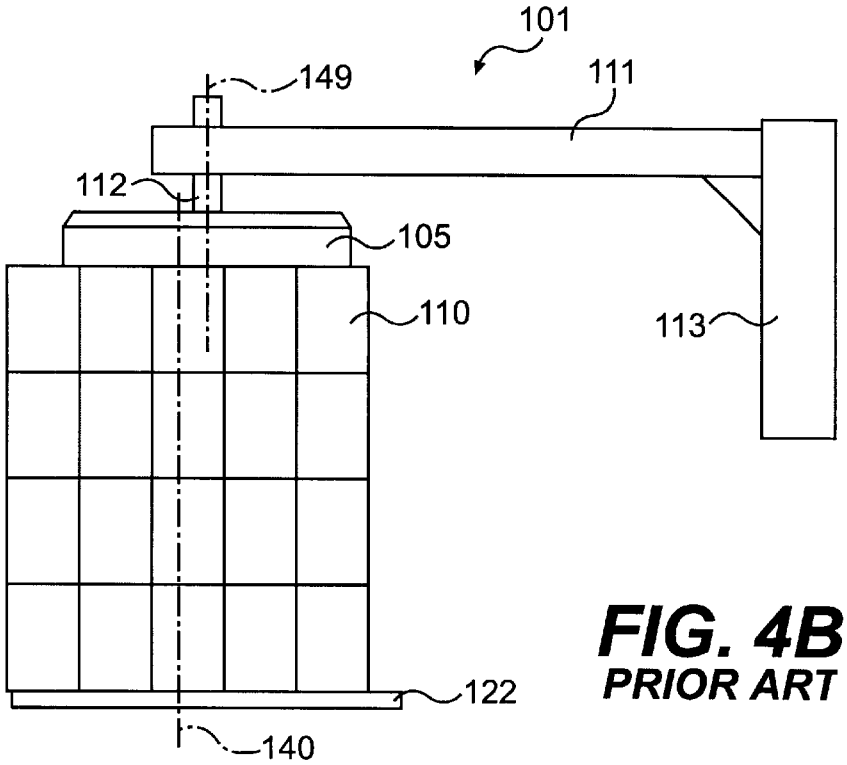
FIG. 4B PRIOR ART
FIG. 4B is a side view of a conventional top platen where the relative center of rotation of the platen pad and the load at the top of the load are offset.

Relative motion denoted by arrow 206 is provided between the stretch wrap dispenser 208 and the load 202 to wrap stretch wrap packaging material 207 around the load 202. In the embodiment shown in FIGS. 3A and 3B, the relative motion is provided by a conventional turntable 222. Alternative mechanisms for providing relative rotation between dispenser 208 and load 202 include an arm or ring 254 which supports and rotates the stretch wrap dispenser 208 as shown in FIGS. 3C and 3D. Another alternative mechanism for providing relative rotational motion between dispenser 208 and load 202 is a combination of a conventional turntable 222*a* and an arm or ring 254*a* which supports and rotates the stretch wrap dispenser 208 as shown in FIGS. 3E and 3F. The relative motion may be provided in the direction shown by arrow 206 or in the reverse direction.

Due to the relative rotation between the dispenser 208 and the load 202, as used herein, the phrase "the center of rotation 240 of the load 202" refers also to the relative center of rotation 240 of the load 202. This rotation may be relative to the dispenser 208, the platen pad 205, or any other rotating part. Similarly, any relative rotation may be accomplished by rotating either one of or both of two bodies relative to each other. Therefore, as used herein, the words "rotation" and "rotate" refer to relative rotation between bodies and is not meant to limit which of the two bodies actually moves.

According to the present invention, as illustrated in FIG. 1, a top platen 201 is used to help maintain the stability of a load 202 during the wrap cycle. The top platen may also hold in place a top sheet of plastic film 203 or other material to be a part of the wrapped load 202. The top platen 101 provides stability by applying a compressive force 204 to the load 202 through a platen pad or plate 205 placed on top of the load 202. The platen pad 205 may be made of two materials, for example, a top portion 245 may be made of metal or similar rigid material and a bottom portion 246 made of a resilient material such as rubber, foam, or similar material. These two portions 246 and 245 together comprise the platen pad 205. Alternatively, the platen pad 205 may include only a single layer or more than two layers of suitable materials. The platen pad 205 may rotate with the load 202, or alternatively, where the load 202 does not rotate, the platen pad 205 remains still with the load 202 while other elements rotate around the load 202.

Platen pad 205 is supported by and mounted to a platen arm 211 via a shaft 212 or tube. Platen arm 211 may be mounted to, and guided on, a platen mast or frame 213. Platen mast 213 may be mounted to the film mast 209, integrated into the design of the film mast 209, or may be completely independent from film mast 209. Platen arm 211 may move up and down platen mast 213 as shown by arrow 237. A structure for raising and lowering the platen arm 211, such as for example, an air piston and cylinder 214, may be provided. The structure for raising and lowering the platen arm 211 is preferably capable of providing a compressive force 204 to the load, the compressive force 204 being greater than the weight of the top platen 201 alone.

According to one aspect of the invention, top platen 201 includes rollers 234 to facilitate the up and down movement 237 of the platen arm 211. Rollers 234 may communicate with a track (not shown) incorporated into or attached to the frame 213. A device may be used to signal the top platen 201 to stop downward travel on the mast 213 once the platen engages the top of the load to be wrapped. One way of facilitating this is to allow the shaft 212 to slide vertically through the arm frame 211, and have some type of switch 215 to recognize pad location.

The apparatus may also include a supporting frame 213. Turntable 222 can be attached to a bottom portion of the supporting frame 213 adjacent mast 209. Dispenser 208 is not attached to the supporting frame 213 but may move adjacent to the frame 213 along mast 209. Platen arm 211 is attached to the top of frame 213. An air cylinder 214 is attached to the frame 213 and to platen arm 211 to raise and lower the platen arm 211. The air cylinder 214 may also transfer a compressive force to the top platen 201 and ultimately to the load 202. A reduction in friction between the frame 213 and the platen arm 211 may be realized by use of rollers 234 attached to the platen arm 211. Rollers 234 roll along a track attached to or part of the frame 213.

Top platen 201 includes a platen arm 211 connected to frame 213 and air cylinder 214 as described above. A shaft housing 255 is attached to the platen arm 211, the shaft housing 255 having a hole 256. A shaft 212 extends into hole 256 of shaft housing 255. Shaft 212 is connected to the platen pad 205. Shaft 212 may have a large diameter cap 235 on one end. Cap 235 is constrained to remain within shaft housing 255 by a constriction 232 in the hole 256. Thus, shaft 212 supports the platen pad 205 when no load is present and when the top platen 201 is disengaged from the load 202. Shaft 212 is of a smaller diameter than the hole 256, and thus is free to gyrate and/or rotate eccentrically within the hole 256 and also to move axially within the hole 256.

The geometric center/longitudinal axis of the top platen 201 passes through the center of hole 256. When platen pad 205 is not engaging a load, the geometric center/longitudinal axis also passes through shaft 212 and through the center of platen pad 205. However, because shaft 212 can move within hole 256, shaft 212 and platen pad 205 to which it is attached are not constrained to rotate around the geometric center/longitudinal axis. Instead, when platen pad 205 is on a rotating load, for example, platen pad 205 on shaft 212 rotates with the load around the load's center of rotation 240. If the center of rotation 240 of the top of the load 202 is not aligned with the geometric center/longitudinal axis of the top platen 201, shaft 212 moves eccentricaly within hole 256 to allow platen pad 205 to rotate with the load 202 around the center of rotation 240 of the top of the load 202.

Figure 5A:
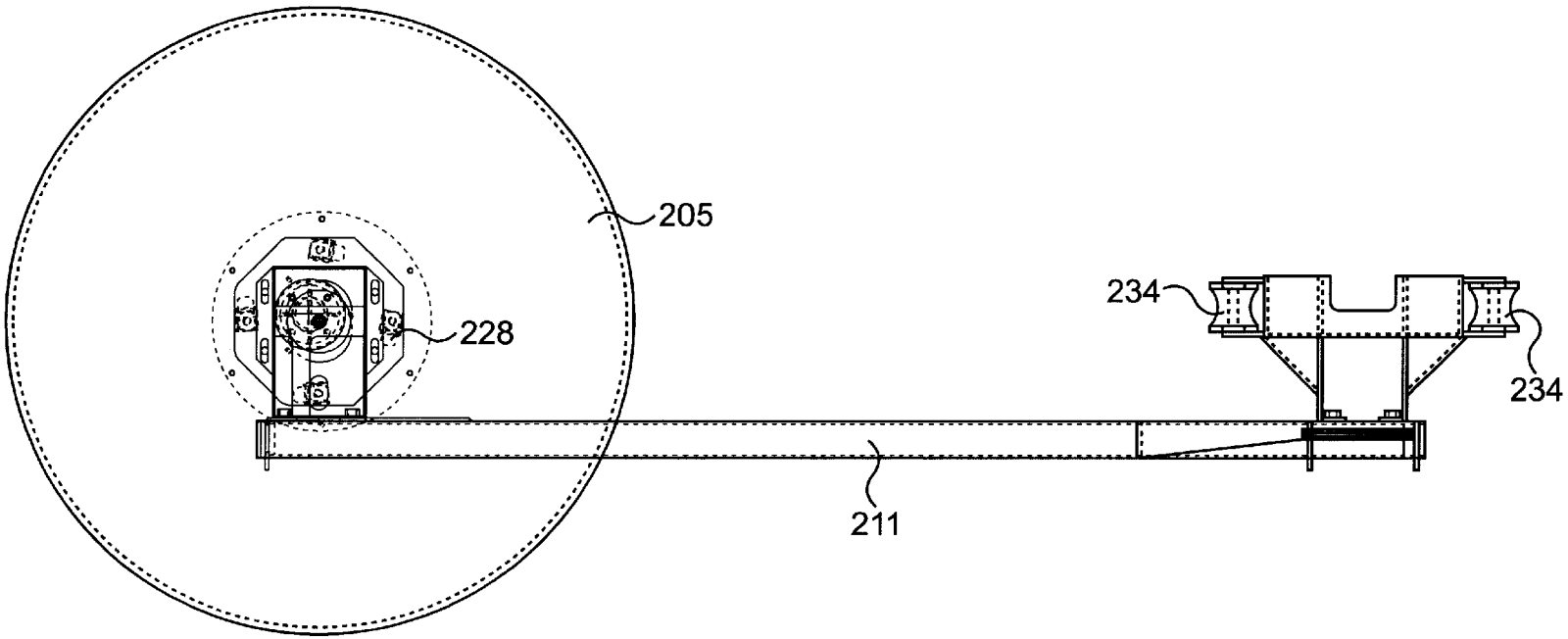
FIG. 5A is a top view of a top platen according one embodiment of the present invention the top platen is shown in the "up" or disengaged position.
Figures 5B, 5C:
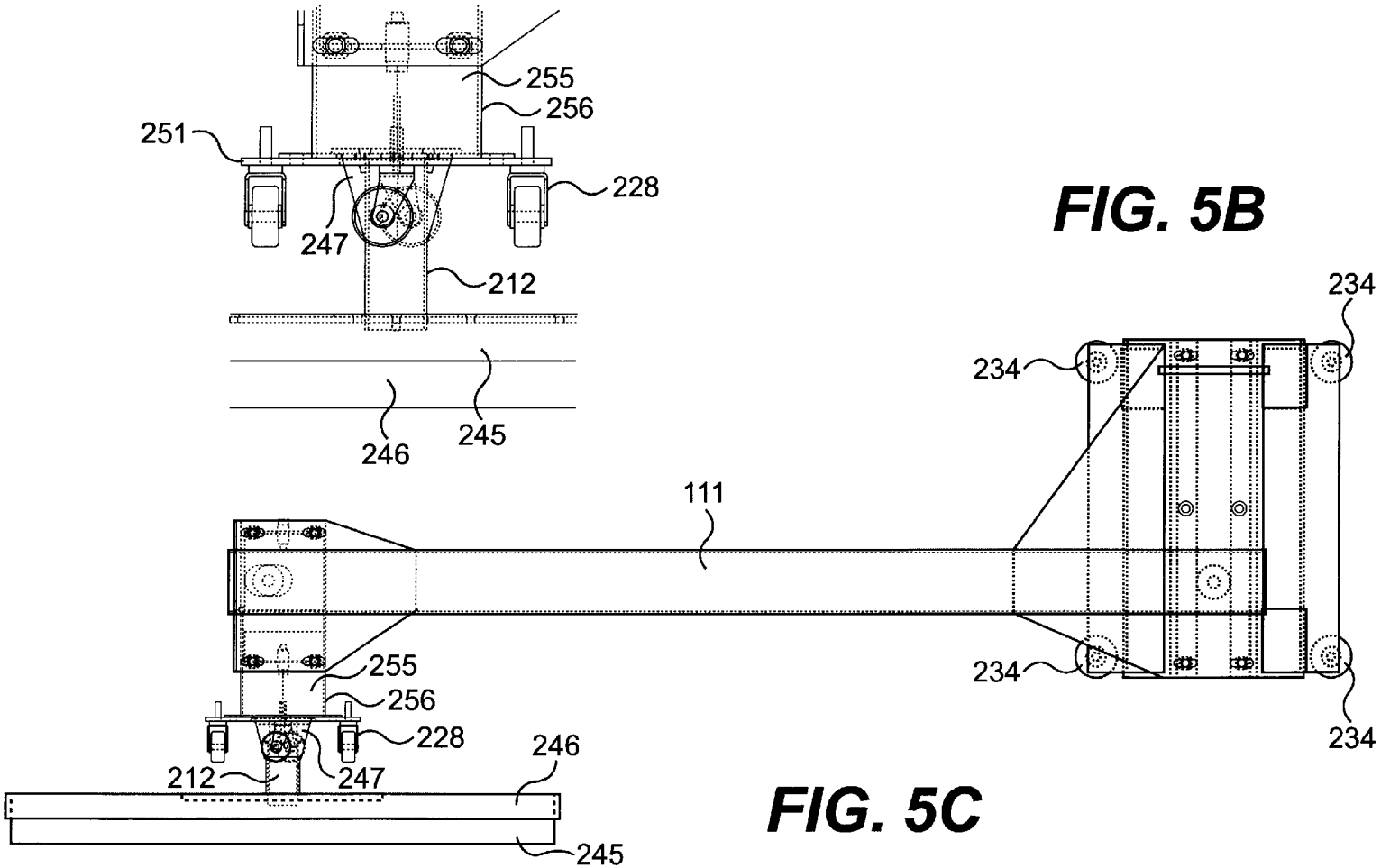
FIG. 5B is a side view of a top platen of FIG. 5A with casters in the "up" or disengaged position and mounted on the top platen according to one aspect of the present invention.
FIG. 5C is a front view of the top platen structure of FIGS. 5A and 5B.
Figure 6:
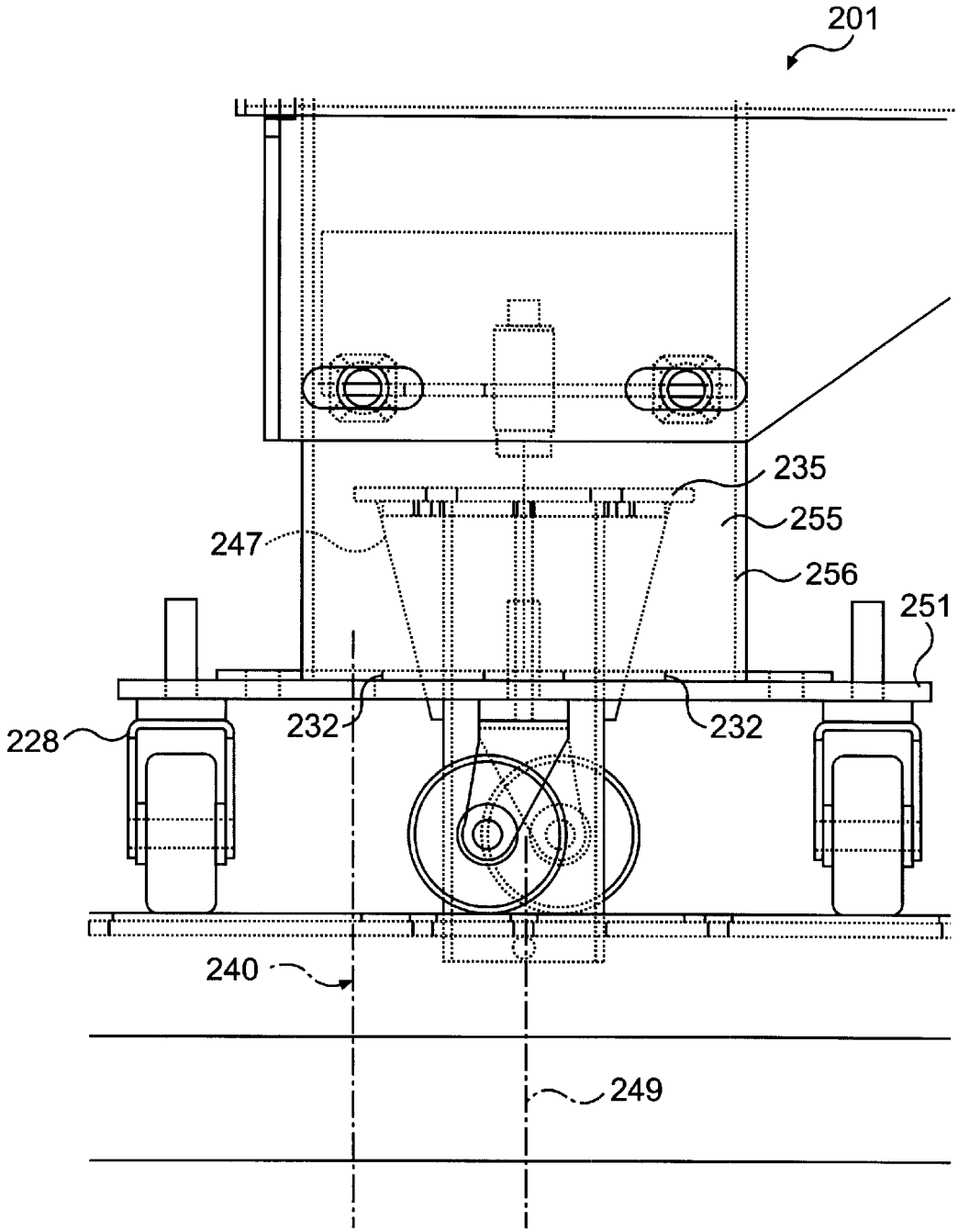
FIG. 6 is an enlarged side view of the top platen where casters are engaging a top of the platen pad according to one aspect of the present invention.
Figure 8:
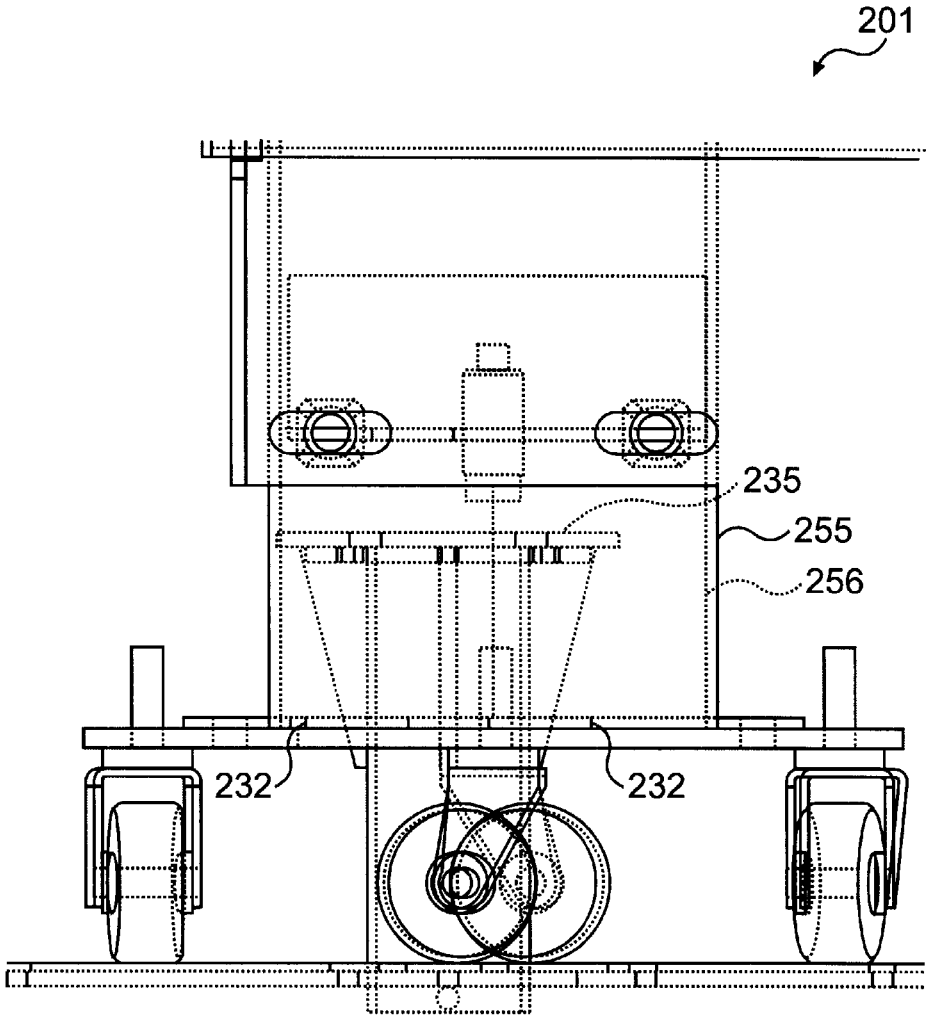
FIG. 8 is a side view of a top platen according to another aspect of the present invention.

According to one aspect of the invention, a pressure plate or pad 251 is attached to the shaft housing 255. The pressure plate 251 may form at least a portion of the shaft housing 255 and may also define at least a portion of the hole 256. Rolling elements, such as casters 228 or balls 260, for example, are associated with the pressure plate 251. The rolling elements 228, 260 are configured to transmit a compressive force 221 from the pressure plate 251 to the platen pad 205. For example, the casters 228 may be mounted to the pressure plate 251 and urge and roll against the top of the platen pad 205, thus transferring force 221 to the platen pad 205. Alternatively, the pressure plate 251 may urge balls 260 against the platen pad 205 and thus transmit compressive force 221 to the platen pad 205. Pressure plate 251 therefore engages and disengages from the platen pad 205 via the rolling elements 228, 260. For example, casters 228 mounted on the pressure plate 251 may be raised and lowered to move out of and into contact with the platen pad 205. FIGS. 1, 5B, and 5C show pressure plate 251 and platen pad 205 in a disengaged configuration (casters 228 are not in contact with or pressing against the platen pad 205), and FIGS. 6 and 8 show pressure plate 251 and platen pad 205 in an engaged configuration (casters 228 are pressing against the platen pad 205). Alternatively, the rolling elements may continuously engage the pressure plate 251 and the platen pad 205.

In accordance with another aspect of the invention, the top platen 201 finds the center of rotation 240 of the top of the load 202 and allows the platen pad 205 to rotate about it. This stabilizes the load 202 during wrapping. The top platen 201 applies a compressive force 204, regardless of whether the center of load rotation 240 at the top of the load 202 is aligned with the geometric center of top platen pad 205. The top platen 201 transfers force 204 to the load 202 without shifting rotation of the platen pad 205 away from the center of rotation 240 of the top of the load 202. This is accomplished by the unique structure of the top platen device 201 applies the compressive force around the rotational axis 249 of the top platen 201 rather than through it. The platen pad 205 and shaft 212 are configured to gyrate and/or rotate eccentrically with respect to the shaft housing 255 about a center of rotation 240 associated with the load 202. Pressure plate 251 extends around hole 256 within which shaft 212 rotates and the rolling elements 228, 260 ride on top of platen pad 205 as it rotates with the load, providing a conduit for the compressive force to be transferred from the pressure plate 251 to platen pad 205 and load 202.

In accordance with one embodiment of the present invention and as shown in FIGS. 1, 5A–C, and 6–8, the top platen 201 transfers compressive force 204 to the platen pad 205 via casters 228. Casters 228 ride on top of platen pad 205 as platen pad 205 rotates around the center of rotation 240 of the top of the load 202.

The rolling elements 228 and 260 will, if properly mounted such that friction associated with them rolling or swiveling on platen pad 205 is lower than the friction between the platen pad 205 and the load 202, permit the platen pad 205 to rotate around the center of rotation 240 of the load 202 without interference.

Once the load begins to rotate, the casters 228 ride on the platen pad 205 as it rotates (eccentrically if necessary) around the center of rotation 240 of the load 202. The shaft 212 also rotates about the center of rotation 240 of the top of the load 202, gyrating and/or rotating eccentrically if necessary, with the platen pad 205 within a range as determined hole 256. When the load is rotated, the amount of friction between the casters 228, the pad 205, and the shaft 212 in the hole 256 is less than the friction between the pad 205 and the load 202, thus the platen pad does not pull the load off center and instead rotates with the load.

Figure 7:
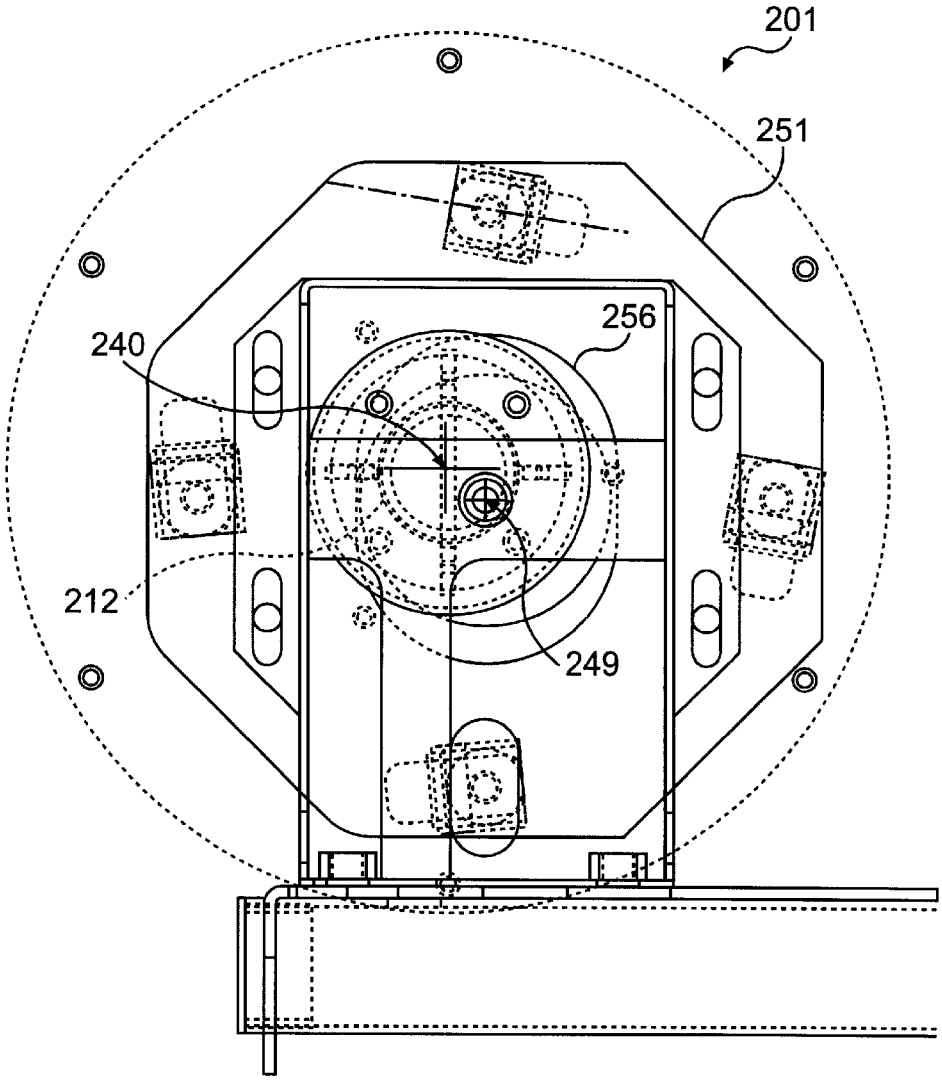
FIG. 7 is a top view of a top platen of the present invention.

FIG. 7 illustrates a top view of an engaged rotating platen pad 205 with casters 228. As shown in FIG. 7, shaft 212 is off center from the geometric center of top platen 201.

Alternatively, top platen 201 may include fins 247. Fins 247 are located on the shaft 212 and are configured to re-center the shaft 212 and platen pad 205 when the rolling elements are disengaged from the pressure plate 251 and platen pad 205. As shown in FIGS. 5B and 5C, fins 247 accomplish the re-centering by communicating with a constriction 232 in the hole 256at the lower end of the shaft housing 255. The fins 247 are diagonally shaped so as the shaft 212 moves axially down through the restriction 232 in the hole 256, the slanted edge of the fins 247 urge against the restriction 232 and move the shaft 212 to the center of the hole 256.

Figure 9:
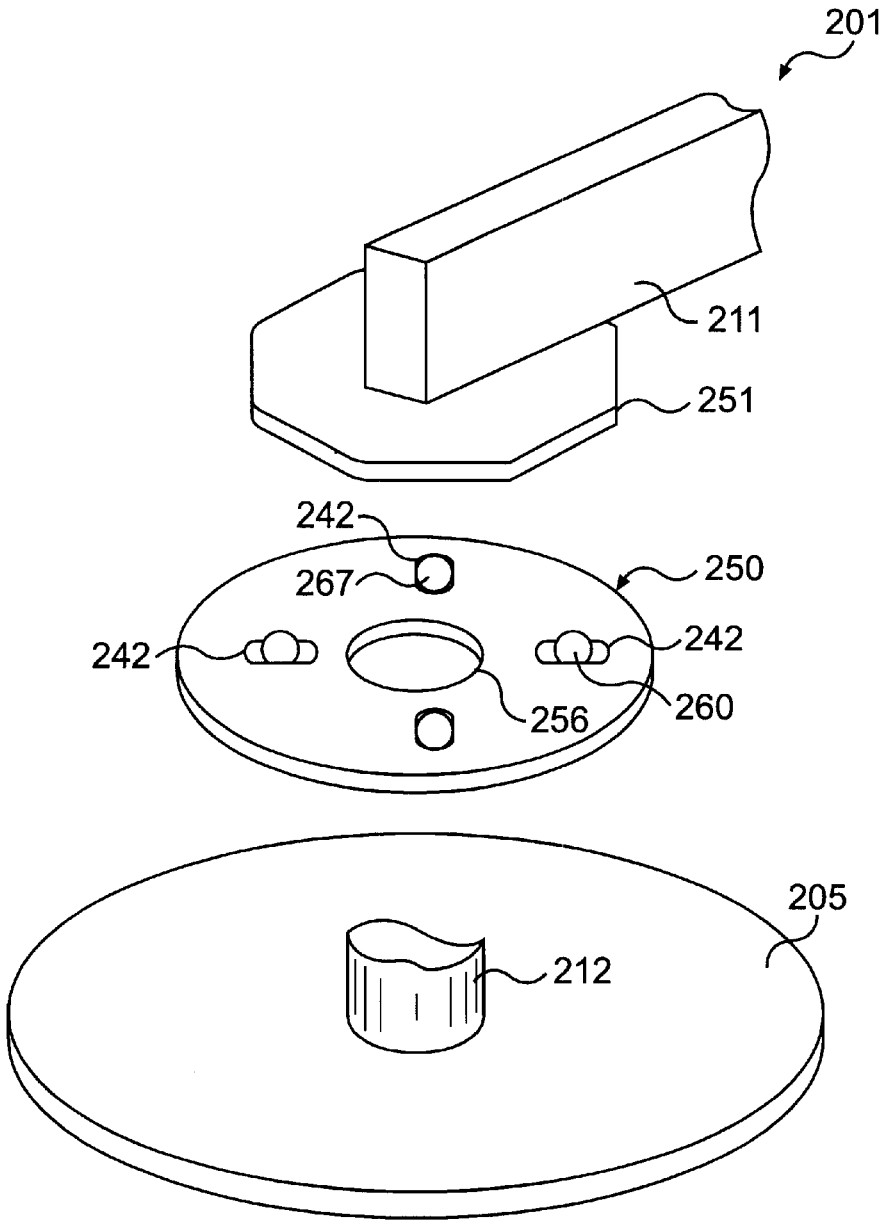
FIG. 9 is an exploded view of a top platen according to another aspect of the present invention.
Figure 10:
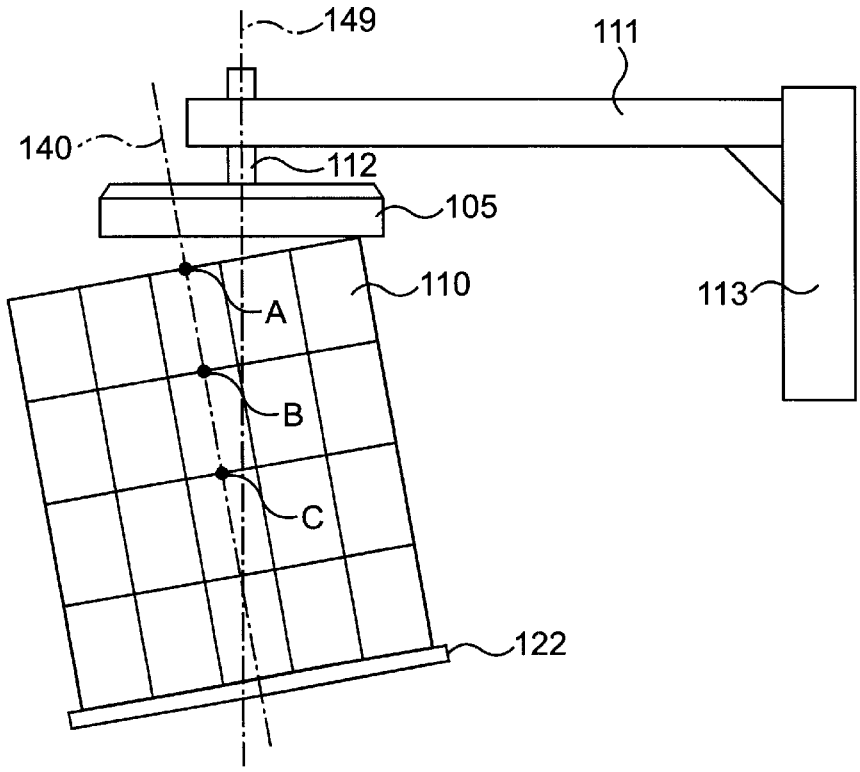
FIG. 10 PRIOR ART
FIG. 10 is a side view of a conventional stretch wrapping apparatus with a conventional top platen.

Alternatively, as shown in FIG. 9, a top platen 201 may transmit compressive force 204 to the load (not shown) using balls 260 in a slotted plate 250.

In this embodiment, the balls 260 in slotted plate 250 allow circular rotation of the platen pad 205 relative to the pressure pad 251, and the platen pad 205 and shaft 212 rotate around the load's true center of rotation 240 while balls 260 in slotted plate 250 transfer the compressing force 204 to platen pad 205 and load 202. This is accomplished by allowing the balls 260 to roll and move within the slots 242 of slotted plate 250 on top of platen pad 205.

A method for stretch wrapping a load according to the present invention is shown in FIG. 1 and will now be described. The method includes dispensing stretch wrap packaging material 207 from a stretch wrap dispenser 208, providing relative rotation between the dispenser 208 and the load 202 to wrap the stretch wrap packaging material 207 around the load 202, and applying a compressive force 204 to the load 202 with a platen pad 205. The method further includes allowing the platen pad 205 to find and rotate around a relative center of rotation 240 associated with a top of the load 202 and to align its rotational axis 249 with the relative center of rotation 240 associated with the top of the load 202, wherein the platen pad 205 is permitted to rotate eccentrically with respect to the top platen's 201 geometric center/longitudinal axis.

Stretch wrap material 207 is dispensed from a dispenser 208. The dispenser 208 moves up and down along mast 209 so that the wrapping material 207 may be applied to the load 202 at all heights.

Relative rotation between the stretch wrap dispenser 208 and the load 202 is provided as described above and shown in FIGS. 3A–3F. A compressive force 204 is applied to the load 202 with top platen 201. The compressive force 204 is transmitted through the pressure plate 251 to platen pad 205 and load 202 via the rolling elements 228, 260 which are being pressed against the platen pad 205.

Top platen 201 is not constrained to rotate around its geometric center/longitudinal axis and can therefore rotate around the relative center of rotation 240 associated with the top of the load 202. The rolling elements ride on the platen pad 205 as it rotates to transfer the compressive force 204 without interfering with the platen pad's ability to rotate around the same center of rotation 240 as the load 202.

FIGS. 6–8 show rolling elements in the form of casters 228 engaging the platen pad 205. As shown in FIG. 6, the casters 228 are engaging the pad 205 and are allowing the platen pad 205 to rotate around the center of rotation 240 of the top of the load 202 while casters 228 move around the geometric center/longitudinal axis of the top platen 201. FIGS. 7–8 show the platen pad shaft 212 with its rotational axis 249 aligned with the relative center of rotation 240 of the top of the load 202, and the casters 228 aligned around the geometric center of the platen pad.

In accordance with the invention, the present invention includes other embodiments where transmitting the compressive force 204 includes balls 260 and a slotted plate 250 as shown in FIG. 9. In this embodiment, the balls 260, slotted plate 250, and the platen pad 205 roll while under pressure from the pressure pad 251 to allow the platen pad 205 to rotate about the relative rotational center 240 of the top of the load 202. This is accomplished by permitting the balls 260 to roll and move within the slots 242 as the platen pad 205 rotates with the load 202.

It will be apparent to those skilled in the art that various modifications and variations can be made in the way the top platen transmits compressive force to the load without unduly influencing the load in the present invention and in construction of this load wrapping machine with an improved top platen without departing from the scope or spirit of the invention. As an example, a large variety of rolling elements may be use which are commonly known. Elements that allow circular rotation of the platen pad 205 relative to the pressure pad 251 as the platen pad 205 rotates about the load's center of rotation 240 at the top of the load will be within the scope of this invention. Insignificant minor changes such attaching to casters 228 (or other rolling elements) to the platen pad 205 rather than the pressure plate 251 and having them urge against a pressure plate 251 are within the scope of this invention. Of course, as previously discussed, rotating different bodies will still provide relative rotation such as shown in FIGS. 3A–3F. This invention is not limited to embodiments where the load 202 and platen pad 205 rotate, but includes and is not limited to embodiments where the load 202 and platen pad 205 do not rotate but other bodies rotate around them.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for wrapping a load with stretch wrap packaging material, comprising:

a dispenser for dispensing stretch wrap material;

means for providing relative rotation between the dispenser and a load, the load having a center of rotation; and a top platen having a rotational geometric center, the top platen configured to apply a compressive force to the load and including a shaft and a platen pad attached to the shaft, the pad being configured to contact and transmit a compressive force to the load;

wherein, when the platen pad is on top of the load and the geometric center of the top platen is not aligned with the load center of rotation, the platen pad and shaft are configured to rotate eccentrically with respect to the geometric center of the top platen in order to rotate about the load center of rotation.

2. The apparatus of claim 1, wherein the means for providing relative rotation between the dispenser and the load includes a turntable configured to support and rotate the load.

3. The apparatus of claim 1, wherein the top platen is mounted on a mast so as to be vertically movable.

4. The apparatus of claim 1, wherein the top platen includes a platen arm supporting the shaft and the platen pad.

5. The apparatus of claim 4, wherein the platen arm is movable on a vertical mast, and wherein movement of the arm is facilitated by rollers.

6. The apparatus of claim 1, wherein the top platen further includes a piston and cylinder to control vertical movement of the top platen.

7. The apparatus of claim 6, wherein the piston is driven by air.

8. The apparatus of claim 1, wherein the platen pad comprises a top portion and a bottom portion.

9. The apparatus of claim 4, wherein the shaft extends through a hole in the platen arm.

10. The apparatus of claim 9, wherein a pressure plate is attached to the platen arm and defines at least a portion of the hole in the platen arm.

11. The apparatus of claim 10, wherein the pressure pad includes rolling elements.

12. The apparatus of claim 11, wherein the rolling elements are positioned around the hole.

13. The apparatus of claim 11, wherein the rolling elements are configured to ride on the platen pad as it rotates with the load.

14. The apparatus of claim 11, wherein the rolling elements are configured to transmit the compressive force from the pressure plate to the platen pad.

15. The apparatus of claim 1, wherein the top platen further includes fins attached to the shaft and configured to move the shaft to a predetermined position between wrapping cycles.

16. The apparatus of claim 15, wherein the fins are configured to re-center the shaft with respect to the geometric center of the top platen between wrapping cycles.

17. The apparatus of claim 11, wherein the rolling elements include at least two casters.

18. The apparatus of claim 17, wherein the rolling elements include four casters.

19. The apparatus of claim 11, wherein the rolling elements do not rotate with respect to the pressure plate.

20. The apparatus of claim 11, wherein the rolling elements include at least two balls within a slotted plate.

21. A method for wrapping a load with stretch wrap packaging material, comprising:

dispensing stretch wrap packaging material from a packaging material dispenser;

providing relative rotation between the dispenser and the load to wrap the stretch wrap packaging material around the load, wherein the load has center of rotation;

placing a portion of a top platen on the top of the load, wherein the top platen includes a rotational geometric center which is not aligned with the load center of rotation; and rotating the portion of the top platen on the top of the load with the load around the load center of rotation and eccentrically relative the geometric center of the top platen.

22. The method of claim 21, further comprising applying a compressive force to the load with the portion of a top platen on the top of the load.

23. The method of claim 22, wherein applying the compressive force to the load includes contacting the portion of the top platen on the top of the load with rolling elements to transfer force from a pressure plate to the portion of the top platen on the top of the load.

24. The method of claim 23, wherein contacting the portion of the top platen on the top of the load with rolling elements includes contacting a platen pad.

25. The method of claim 24, wherein contacting the portion of the top platen on the top of the load with rolling elements further includes contacting the platen pad around a shaft supporting the platen pad.

26. The method of claim 21, wherein placing the portion of the top platen on the top of the load includes placing a platen pad on the top of the load.

27. The method of claim 26, wherein placing the portion of the top platen on the top of the load further includes lowering the platen pad onto the load with a shaft.

28. The method of claim 27, wherein rotating the platen pad and shaft eccentrically about the geometric center of the top platen includes rotating the shaft within a hole in a shaft housing.

29. The method of claim 21, wherein rotating the portion of the top platen eccentrically around the geometric center of the top platen includes rotating a platen pad and shaft eccentrically around the geometric center of the top platen.

30. The method of claim 22, wherein applying the compressive force to the load includes transferring the force from a pressure plate to the portion of the top platen on the load via balls in a slotted plate.

31. The method of claim 21, further comprising placing the portion of the top platen on the load such that the geometric center of the top platen is offset from the load center of rotation.

* * * * *